US011286841B2

(12) United States Patent
Takano et al.

(10) Patent No.: US 11,286,841 B2
(45) Date of Patent: Mar. 29, 2022

(54) PRIME MOVER AND WORKING MACHINE HAVING THE SAME

(71) Applicant: KUBOTA CORPORATION, Osaka (JP)

(72) Inventors: Yuki Takano, Sakai (JP); Makoto Noguchi, Sakai (JP); Tetsuji Matsushita, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 101 days.

(21) Appl. No.: 16/381,973

(22) Filed: Apr. 11, 2019

(65) Prior Publication Data

US 2019/0316513 A1 Oct. 17, 2019

(30) Foreign Application Priority Data

Apr. 12, 2018 (JP) ..... JP2018-076753

(51) Int. Cl.

| | |
|---|---|
| ***F01P 7/02*** | (2006.01) |
| ***F01P 5/02*** | (2006.01) |
| ***F01M 13/00*** | (2006.01) |
| ***F01M 13/04*** | (2006.01) |
| ***F02M 35/10*** | (2006.01) |

(52) U.S. Cl.

CPC ..... *F01P 7/02* (2013.01); *F01M 13/00* (2013.01); *F01M 13/04* (2013.01); *F01P 5/02* (2013.01); *F02M 35/10222* (2013.01); *F01M 2013/0438* (2013.01)

(58) Field of Classification Search

CPC ..... F01M 13/00; F01M 13/04; F01M 2013/0438; F01P 7/02; F01P 5/02; F02M 35/10222

USPC ..... 123/41.65

See application file for complete search history.

(56) References Cited

U.S. PATENT DOCUMENTS

| | | | | |
|---|---|---|---|---|
| 2007/0006857 | A1* | 1/2007 | Miyake | F02M 25/06 123/572 |
| 2009/0241921 | A1* | 10/2009 | Ito | F01M 13/04 123/573 |
| 2014/0366855 | A1* | 12/2014 | Kitagawa | F01M 13/00 123/572 |
| 2014/0373821 | A1* | 12/2014 | Kitagawa | F02M 35/1038 123/572 |
| 2017/0370256 | A1* | 12/2017 | Tokunaga | F01P 3/12 |

FOREIGN PATENT DOCUMENTS

| | | | |
|---|---|---|---|
| CN | 20301621 | U | 9/2013 |
| EP | 1510884 | A2 | 3/2005 |
| JP | 4-131521 | U | 12/1992 |
| JP | 8-284660 | A | 10/1996 |
| JP | 2912-127254 | A | 7/2012 |

(Continued)

*Primary Examiner* — Lindsay M Low
*Assistant Examiner* — Omar Morales
(74) *Attorney, Agent, or Firm* — Birch, Stewart, Kolasch & Birch, LLP

(57) ABSTRACT

A prime mover includes an engine, a fan to generate a cooling airflow around the engine, an air-intake tube to supply outside air to the engine, a connection tube to supply, to the air-intake tube, a blow-by gas generated in the engine, and a wind shielding member to shield the connection tube from the cooling airflow, the wind shielding member being arranged around the connection tube.

7 Claims, 14 Drawing Sheets

(56) References Cited

FOREIGN PATENT DOCUMENTS

| | | | |
|---|---|---|---|
| JP | 2016-133088 | A | 7/2016 |
| JP | 2017-141770 | A | 8/2017 |
| WO | WO 2016/039143 | A1 | 3/2016 |

* cited by examiner

PRIME MOVER AND WORKING MACHINE HAVING THE SAME

CROSS-REFERENCE TO RELATED APPLICATIONS

The present application claims priority under 35 U.S.C. § 119 to Japanese Patent Application No. 2018-076753, filed Apr. 12, 2018. The content of this application is incorporated herein by reference in their entirety.

BACKGROUND OF THE INVENTION

Field of the Invention

The present invention relates to a prime mover having a connection tube in which a blow-by gas generated by the prime mover flows toward an air-intake tube.

Discussion of the Background

A prime mover disclosed in Japanese Patent Application Publication No. 2017-141770 is previously known as a prime mover having a blow-by gas recirculation structure in which the blow-by gas (air-fuel mixture or combustion gas leaked into the engine housing from the gap between the piston and cylinder of the prime mover) is supplied to the intake tube and then re-combusted.

SUMMARY OF THE INVENTION

Problems to be Solved by the Invention

However, in the prime mover disclosed in Japanese Patent Application Publication No. 2017-141770, the blow-by gas flowing through the inside of the connection tube is cooled when the working machine such as a tractor provided with the prime mover is used under the low temperature conditions such as a cold region, and then liquids such as the oil (engine oil) and water included in the blow-by gas may freeze and the connection tube may be clogged in the middle of the connection tube.

The present invention is provided to solve the problems of the conventional technique mentioned above, and intends to suppress, inside the connection tube, freezing of the liquid included in the blow-by gas.

Means of Solving the Problems

A prime mover according to one aspect of the present invention, includes an engine, a fan to generate a cooling airflow around the engine, an air-intake tube to supply outside air to the engine, a connection tube to supply, to the air-intake tube, a blow-by gas generated in the engine, and a wind shielding member to shield the connection tube from the cooling airflow, the wind shielding member being arranged around the connection tube.

Effects of the Invention

According to the above-mentioned prime mover and a working machine provided with the prime mover, it is possible to prevent a cooling airflow generated by the fan from being directly blown to the connection tube, and thereby the freezing of the liquid included in the blow-by gas can be suppressed inside the connection tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
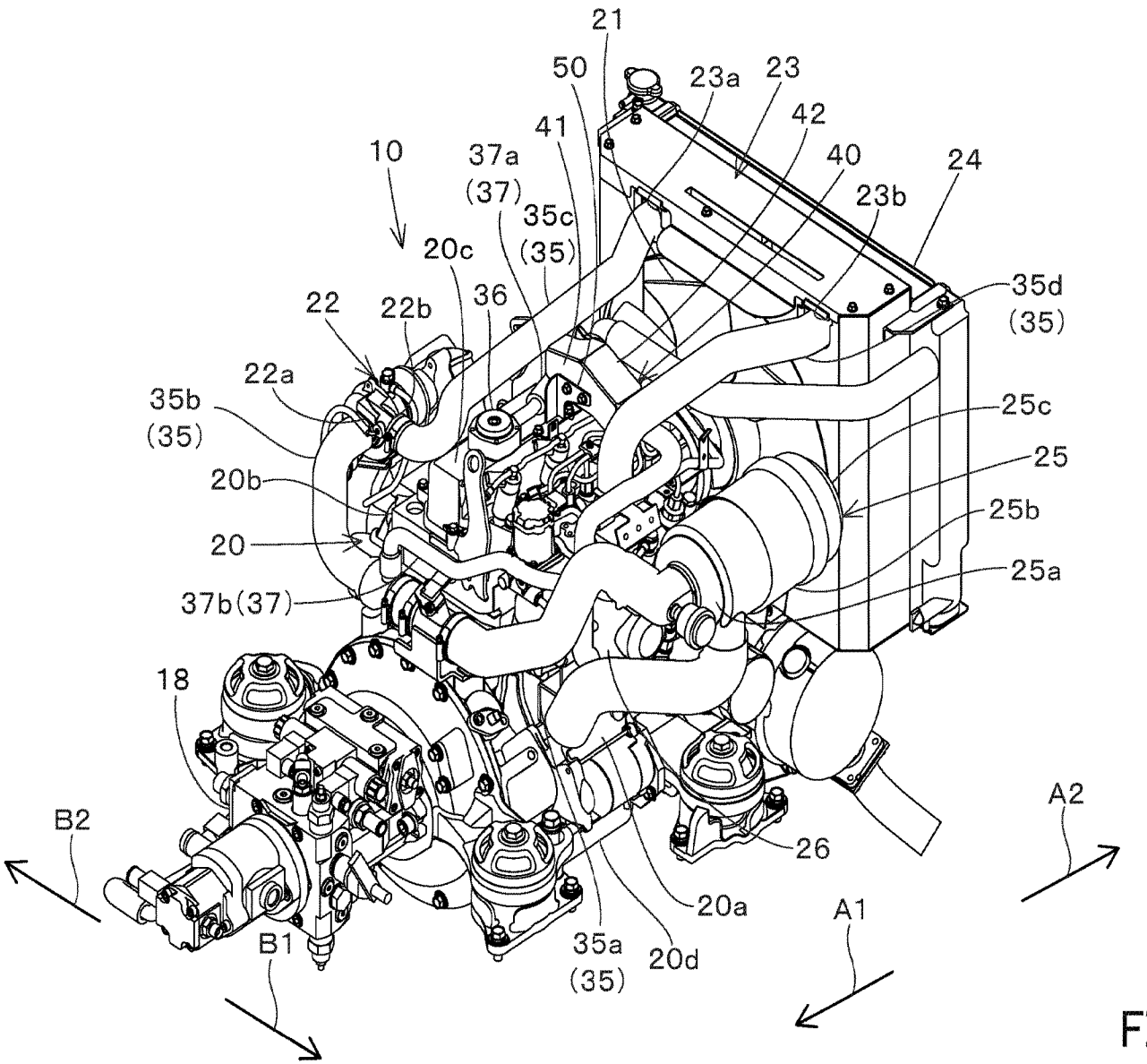
FIG. 1 is a perspective view illustrating left-front portions of a prime mover, an inter cooler, a radiator, and the like according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Figure 13:
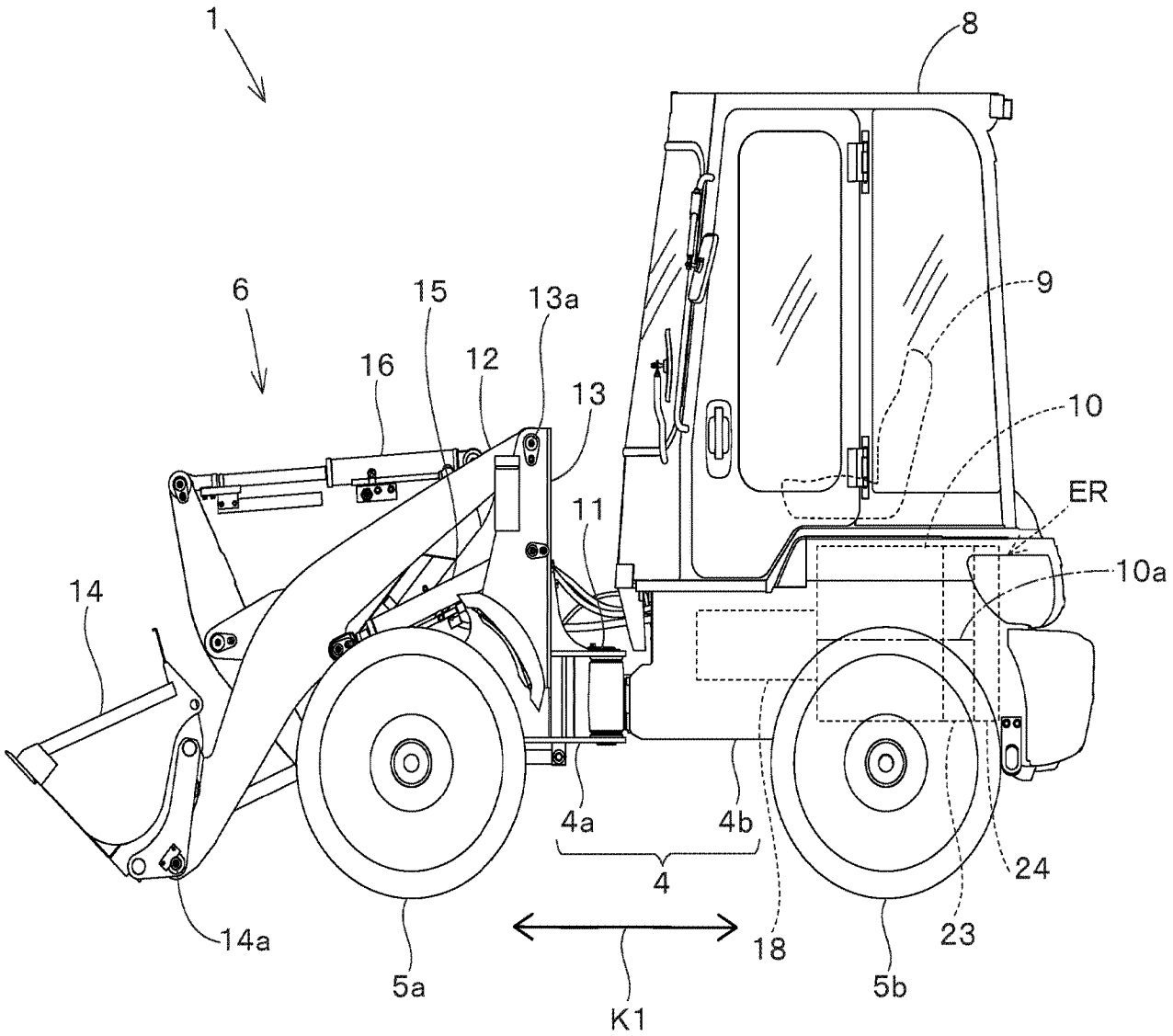
FIG. 13 is a view illustrating a left side of a working machine according to the embodiment.

FIG. 13 is a schematic view showing an overall configuration of a working machine 1 according to the embodiment of the present invention. In the present embodiment, an articulated wheel loader is illustrated as the working machine 1. However, the application object of the present invention is not limited to the articulated wheel loader, and can be applied to the agricultural machines such as a tractor, the construction machines such as a backhoe, various types of vehicles, and the like.

The working machine 1 includes a traveling machine body 4, a working device 6, and a cabin 8.

Hereinafter, in the explanation of the embodiment, the front side (the left side in FIG. 13) of an operator seated on the operator seat 9 of the cabin 8 is referred to as the front. The rear side (the right side in FIG. 13) of the operator is referred to as the rear. The left side (the front surface side of FIG. 13) of the operator is referred to as the left. The right side (the back surface side of FIG. 13) of the operator is referred to as the right. In addition, a horizontal direction which is a direction orthogonal to the front-rear direction (see the arrowed line K1 in FIG. 13) will be described as a machine width direction.

As shown in FIG. 13, the traveling machine body 4 has a front machine body 4*a* and a rear machine body 4*b*. The front machine body 4*a* is provided with a pair of front wheels 5*a* (a right front wheel 5*a* and a left front wheel 5*a*). The rear machine body 4*b* is provided with a pair of rear wheels 5*b* (a right rear wheel 5*b* and a left rear wheel 5*b*).

On the front end side of the rear machine body 4*b*, a coupling member 11 is provided rotatably about an axis extending along the front-rear direction. The rear end side of the front machine body 4*a* is connected to the coupling member 11 so as to be able to swing leftward and rightward around an axis extending along the vertical direction.

The working device 6 has a pair of lift arms 12 and a bucket 14. The lift arms 12 are arranged to face each other in the machine width direction. The base end sides of the pair of lift arms 12 are supported by the support frame 13 rotatably about the axis of the pivot shaft 13*a* extending in the left-right direction, the support frame 13 being provided on the front machine body 4*a*, and thus the pair of lift arms 12 can be moved upward and downward.

The bucket 14 is pivotally connected to the tip end sides of the pair of lift arms 12 so as to be swingable about the axial center of a pivot shaft 14*a* extending in the lateral direction. The pair of lift arms 12 are driven by a lift cylinder 15. The bucket is driven by a bucket cylinder 16. The lift cylinder 15 and the bucket cylinder 16 are constituted of hydraulic actuators, that is, constituted of hydraulic cylinders more specifically.

In addition, the bucket 14 is detachably provided. Instead of the bucket 14, an attachment such as a sweeper, a mower, and a breaker can be attached to the tip end sides of the lift arms 12.

The rear machine body 4*b* is provided with the operator seat 9, the cabin 8 serving as an operator seat protection device, a steering wheel (not shown in the drawings) for operating the steering cylinder, and a working device operation lever (not shown in the drawings) for operating the working device 6.

As shown in FIG. 13, the rear body 4*b* is provided with a prime mover room ER. In the prime mover room ER, a prime mover 10, a hydraulic pump 18, an intercooler 23, a radiator 24, an air cleaner 24, and the like are arranged.

The prime mover 10 is an engine in the present embodiment, that is, the prime mover 10 is a diesel engine more specifically. As shown in FIG. 13, the prime mover 10 is arranged in a longitudinal direction such that the output shaft 10*a* is directed in the front-rear direction.

Next, the prime mover 10 will be explained in detail mainly referring to FIG. 1 to FIG. 3 and FIG. 8. In each of the drawings, an arrowed line A1 indicates the front, an arrowed line A2 indicates the rear, an arrowed line B1 indicates the left, and an arrowed line B2 indicates the right.

Figure 2:
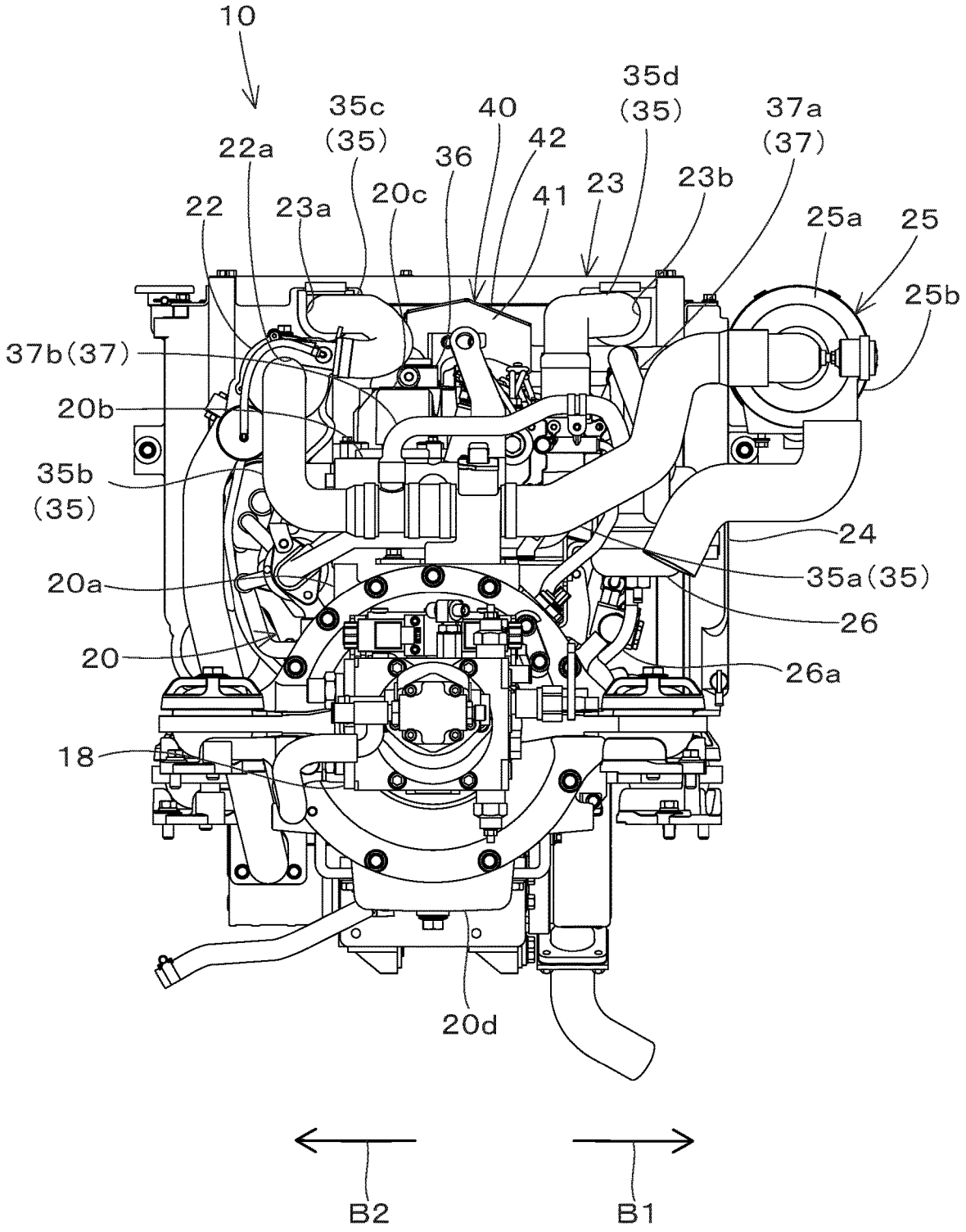
FIG. 2 is a front view illustrating the prime mover, the inter cooler, a hydraulic pump, and the like according to the embodiment.
Figure 3:
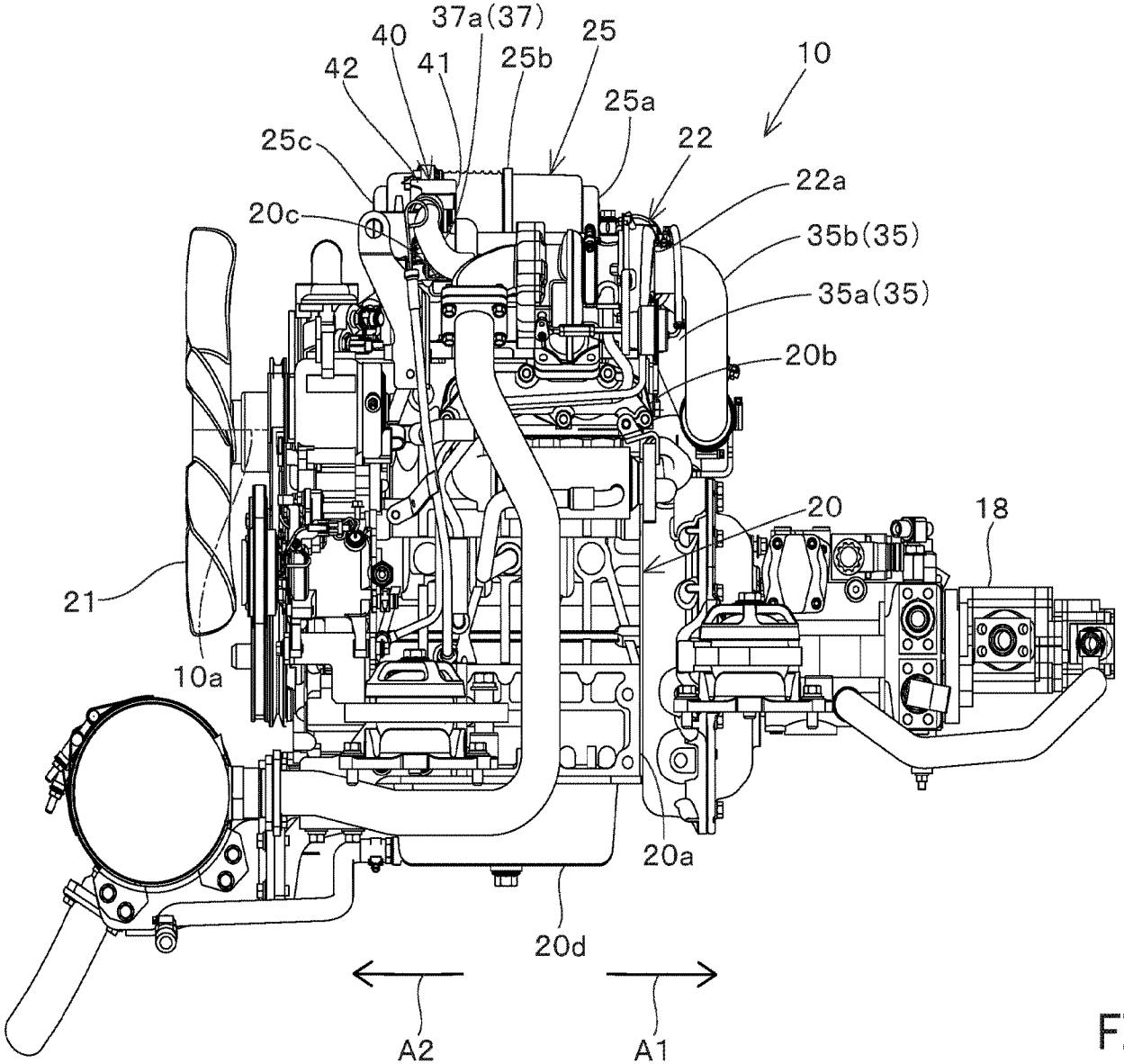
FIG. 3 is a view illustrating right sides of the prime mover, the hydraulic pump, a fan, and the like according to the embodiment.
Figure 8:
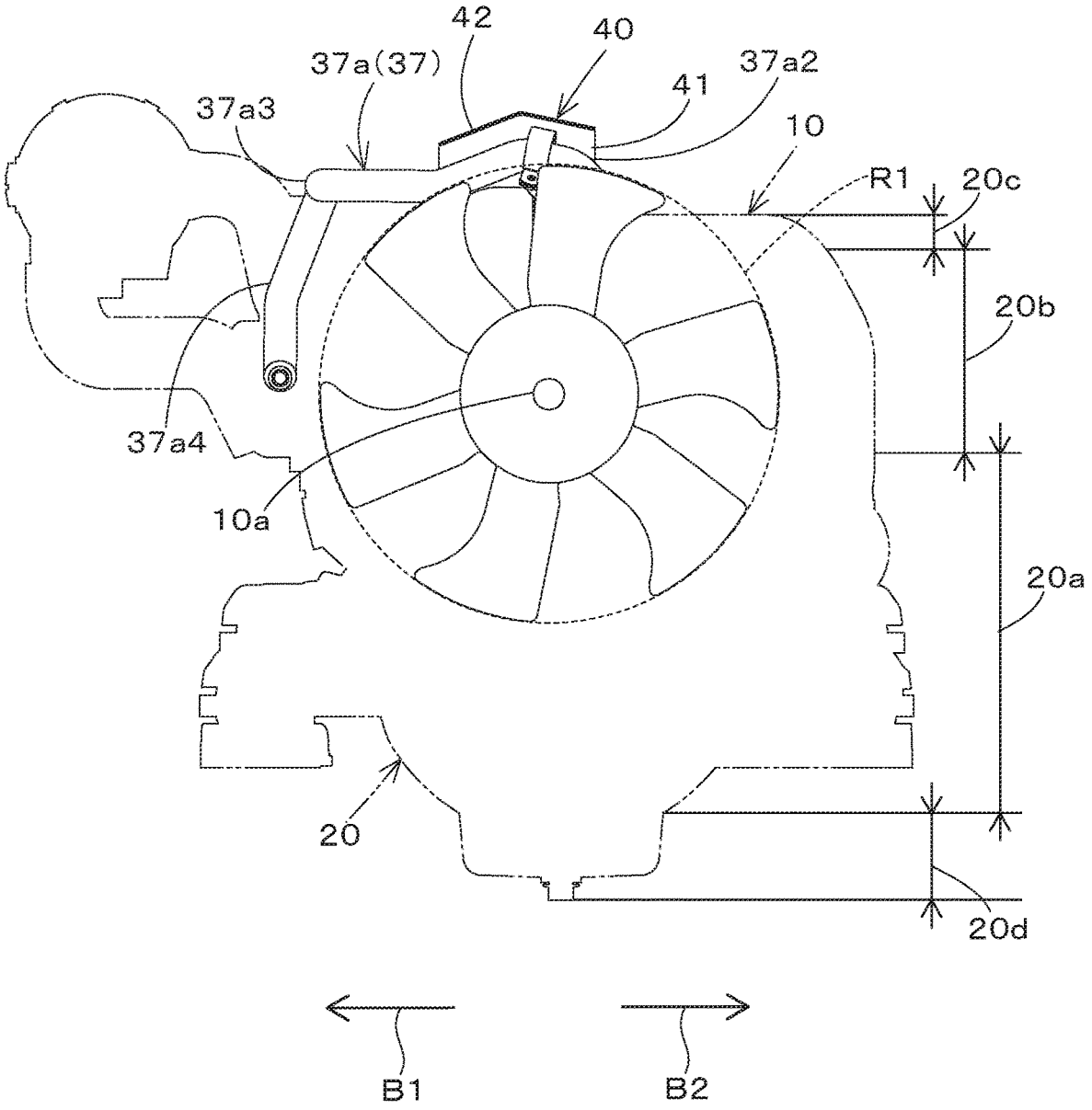
FIG. 8 is a back view illustrating the fan, the windshield plate, and the like according to the embodiment.

FIG. 2 is a front view showing the prime mover 10, the hydraulic pump 18, the intercooler 23, and the like. FIG. 3 is a right side view showing the prime mover 10, the fan 21, the hydraulic pump 18 and the like. FIG. 8 is a back view showing the wind shielding plate 40, the fan 21 and the like.

As shown in FIG. 1 to FIG. 3 and FIG. 8, the prime mover 10 includes a cylinder block 20*a*, a cylinder head 20*b*, a cylinder head cover 20*c*, and an oil pan 20*d*. The cylinder block 20*a* includes a cylinder portion and a crankcase. A plurality of pistons are housed in the cylinder portion.

The plurality of pistons reciprocate inside the cylinder portion to perform suction, compression, expansion, and exhaust. The crankcase houses a crankshaft. The crankshaft converts the reciprocating motions of the plurality of pistons into the rotational motion. The cylinder head 20*b* is provided on an upper portion of the cylinder block 20*a*.

In the cylinder head 20*b*, an ignition plug, a cam shaft and the like are housed. The cylinder head cover 20*c* is provided on an upper portion of the cylinder head 20*b*. The cylinder head cover 20*c* is a cover that covers over the cylinder head 20*b*. The oil pan 20*d* is provided on a lower portion of the cylinder block 20*a*. The oil pan 20*d* prevents the outflow of the oil (engine oil) of the prime mover 10.

In the following description, a component including the cylinder block 20*a*, the cylinder head 20*b*, and the cylinder head cover 20*c* is referred to as an engine housing 20. The output shaft 10*a* is arranged, inside the engine housing 20, extending in the front-rear direction.

As shown in FIG. 3 and the like, the hydraulic pump 18 is provided in front of the prime mover 10. The hydraulic pump 18 is driven by the prime mover 10. The hydraulic pump 18 outputs an operation fluid for operating the hydraulic actuators such as the steering cylinder, the lift cylinder 15, and the bucket cylinder 16 provided in the working machine 1.

As shown in FIG. 3, a fan 21 is provided behind the prime mover 10. The fan 21 is attached rotatably and integrally with the rear portion of the output shaft 10*a*. The fan 21 is rotationally driven by the power of the prime mover 10 to generate a cooling airflow.

In particular, the fan 21 generates the cooling airflow flowing from the front to the rear in the present embodiment. That is, the fan 21 generates the cooling airflow around the prime mover (engine) 10.

As shown in FIG. 1 and FIG. 2, a supercharger 22 is arranged above the right portion of the prime mover 10. When the turbine inside the supercharger 22 is rotated by the exhaust gas discharged from the prime mover 10, the supercharger 22 supplies, to the prime mover 10, the air compressed by the compressor of the supercharger 22.

The intercooler 23 is a cooler configured to cool the compressed air that will be supplied from the compressor side of the supercharger 22 to the prime mover 10. In particular, the intercooler 23 cools the air introduced from the supercharger 22. As shown in FIG. 1, the intercooler 23 is arranged behind the fan 22.

The radiator 24 is arranged behind the intercooler 23, and is cooled by the cooling airflow generated by the fan 21. The radiator 24 cools the cooling water that will be supplied to the prime mover 10.

The air cleaner 25 is provided on the left side of the rear upper portion of the prime mover 10. The air cleaner 25 removes foreign substances such as the dust and the dirt that are contained in the air sucked from the outside. The air cleaner 25 has the first side surface 25*a* formed in a substantially cylindrical shape and the second side surface 25*c* formed in a substantially cylindrical shape. In the air cleaner 25, the length of the cylindrical portion 25*b* in the front-rear direction is longer than the diameters of the first side surface 25*a* and the second side surface 25*c*.

The prime mover 10 is provided with an air intake tube 35. The air intake tube 35 is connected to the engine housing 20, and supplies the air from the outside of the engine housing 20 to the inside of the engine housing 20. That is, the air intake tube 35 supplies the outside air to the prime mover (engine) 10.

As shown in FIG. 1, FIG. 2, and the like, the air intake tube 35 is arranged above the engine housing 20. One end side of the air intake tube 35 is connected to the inside of the engine housing 20. In particular, one end side of the air intake tube 35 is connected to the inside of the cylinder head 20*b*. An air cleaner 25 is connected to the other end side of the air intake tube 35.

The air intake tube 35 includes a first air intake tube 35*a*, a second air intake tube 35*b*, a first cooling tube 35*c*, and a second cooling tube 35*d*. The first air intake tube 35*a*, the second air intake tube 35*b*, the first cooling tube 35*c*, and the second cooling tube 35*d* are each constituted of hollow tubes, for example, hoses or pipes.

Figure 4:
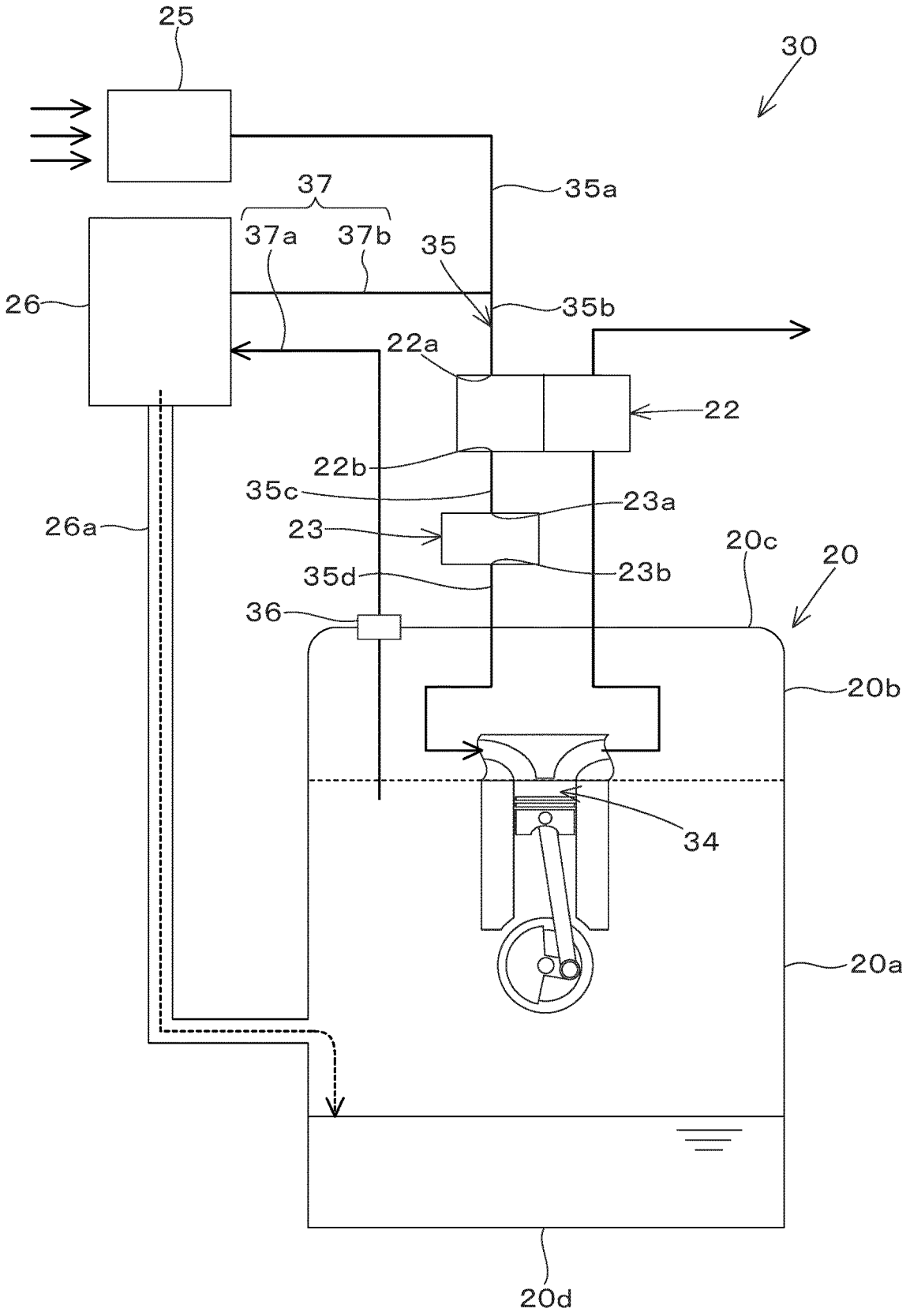
FIG. 4 is a schematic view illustrating a blow-by gas recirculation structure according to the embodiment.

As shown in FIG. 4, the first air intake tube 35*a* communicates the air cleaner 25 and the second air intake tube 35*b* with each other.

The second air intake tube 35*b* communicates the outlet of the first air intake tube 35*a* with the inlet 22*a* of the supercharger 22, the inlet 22*a* being arranged on the compressor side.

The first cooling tube 35*c* communicates the inlet 23*a* of the intercooler with the outlet 22*b* of the supercharger 22, the outlet 22*b* being arranged on the compressor side.

The second cooling tube 35*d* communicates the outlet 23*b* of the intercooler with the inside of the engine housing 20. In particular, the second cooling tube 35*d* is connected to an intake manifold arranged in the cylinder head 20*b*.

As shown in FIG. 4, the prime mover 10 includes a blow-by gas recirculation structure 30. As shown in FIG. 4, the blow-by gas recirculation structure 30 is configured to supply the blow-by gas (the mixture gas and the combustion gas leaking from the gap between the piston and the cylinder of the prime mover 10 into the engine housing 20) into a cylinder formed in the engine housing 20 with the intake air flow, and then to re combust the blow-by gas.

The blow-by gas recirculation structure 30 has a blow-by gas path. The blow-by gas path is formed in the engine housing 20. The blow-by gas path allows the blow-by gas generated in the engine housing (crankcase) 20 to flow from the inside of the cylinder head cover 20*c* to the outside.

As shown in FIG. 4, the blow-by gas recirculation structure 30 includes a connection tube 37 connected to the cylinder head cover 20*c*. For example, a PCV valve is provided on the upper portion of the cylinder head cover 20*c*, and an outlet 36 for the blow-by gas is formed in the PCV valve.

The PCV valve controls the amount of the blow-by gas that will be recirculated when the blow-by gas is sent to the cylinder together with the intake air for re-combustion. The PCV valve may be provided at the joining position between the connection tube 37 and the air intake tube 35.

The cylinder head cover 20*c* is in communication with the oil separator 26 with the connection tube 37. The oil separator 26 is provided leftward on the upper portion of the prime mover 10. The oil separator 26 is attached to the prime mover 10 with an attachment bracket (not shown in the drawings). The oil separator 26 separates the mist of engine oil mixed with the blow-by gas from the blow-by gas.

The oil return passage 26*a* extends from the lower portion of the oil separator 26, and is in communication with the inside of the engine housing (crank case) 20. The engine oil separated from the blow-by gas by the filter (the oil separator) 26 returns to the inside of the engine housing 20 through the oil return path 26*a* by the gravity fall. The oil separator 26 is covered with a heat insulating material.

The connection tube 37 communicates the cylinder head cover 20*c* (PCV valve) and the oil separator 26 with each other, and is connected to the air intake tube 35. The connection tube 37 recirculates the blow-by gas generated in the prime mover (engine) 10 to the air intake tube 35.

As shown in FIG. 1, the connection tube 37 is arranged extending above the engine 10. The connection tube 37 is, for example, constituted of a hollow tube such as a pipe or a hose. The outer circumference of the connection tube 37 is covered with a heat insulating material. The connection tube 37 includes a first connection tube 37*a* and a second connection tube 37*b*.

Figure 5:
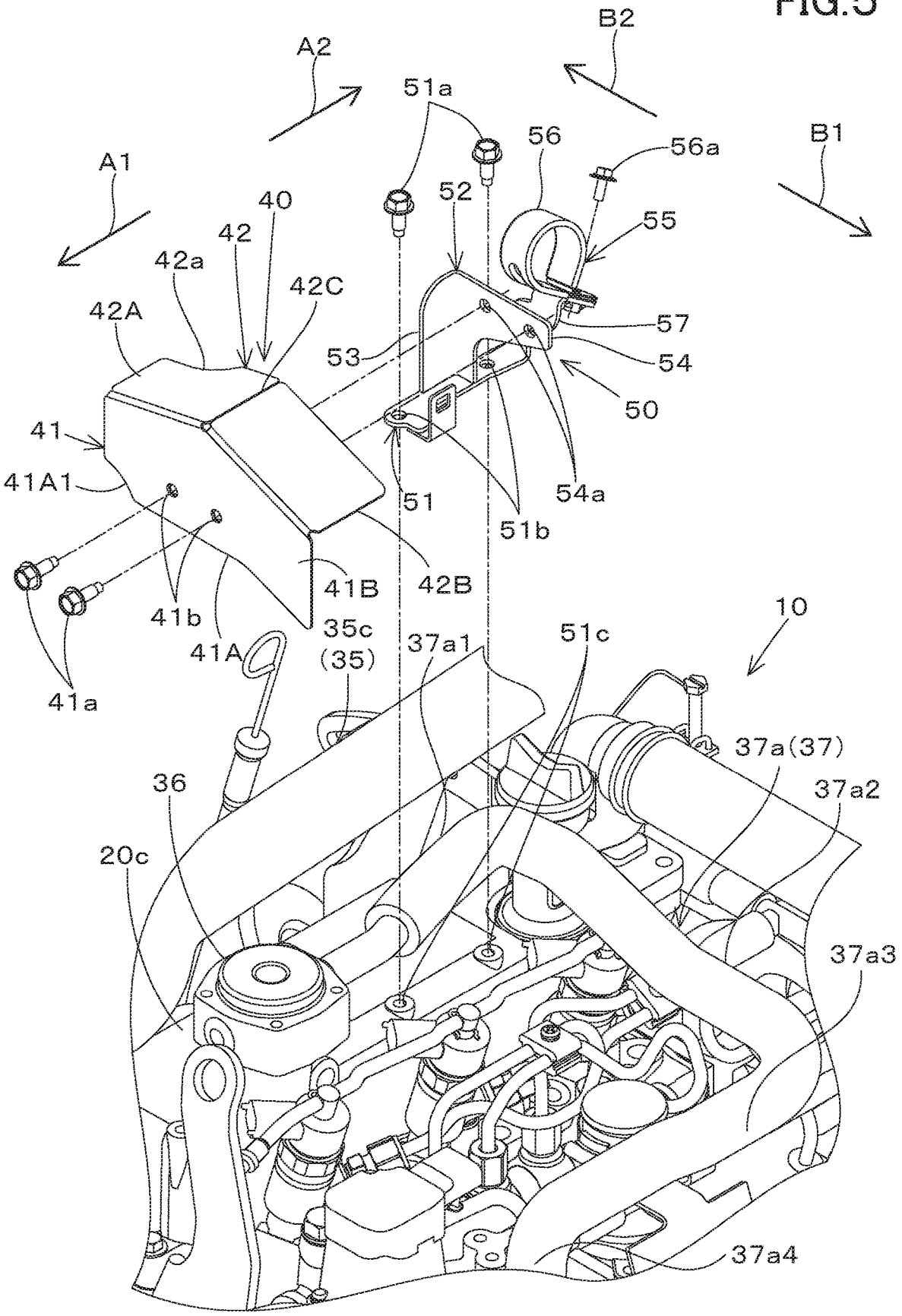
FIG. 5 is an exploded perspective view illustrating a windshield plate, a bracket, and the like according to the embodiment.

As shown in FIG. 5, the first connection tube 37*a* has a first portion 37*a*1 extending backward from the connection portion 36 of the cylinder head cover 20*c*, a second portion 37*a*2 extending leftward from the end portion of the first portion 37*a*1, a third portion 37*a*3 extending forward from the end portion of the second portion 37*a*2 above the left end portion of the engine housing 20, and fourth portion 37*a*4 extending downward from the end portion of the third portion 37*a*3 and being connected to the oil separator 26.

In addition, the second portion 37*a*2 includes an upstream side portion extending obliquely upward from the first portion 37*a*1 side to the third portion 37*a*3 side, a middle portion curved from the upstream side portion and extending obliquely downward toward the third portion 37*a*3 side, and a downstream side portion curved from the left end portion of the middle portion and extending substantially horizontally toward the third portion 37*a*3.

In addition, the second portion (flow path intersecting portion) 37*a*2 is arranged at a position intersecting with the flow path of the cooling airflow generated by the fan 21 (in the embodiment, a position substantially orthogonal to the flow path). Meanwhile, the downstream side portion of the first connection tube 37*a* is orthogonal to the second cooling tube 35*d* when viewed from above.

The prime mover 10 is provided with a wind shielding plate (wind shielding member) 40 which shields a part of the connection tube 37 (a flow path intersecting portion 37*a*2 intersecting with the flow path of the cooling airflow generated by the fan 21) from the cooling airflow.

Figure 6:
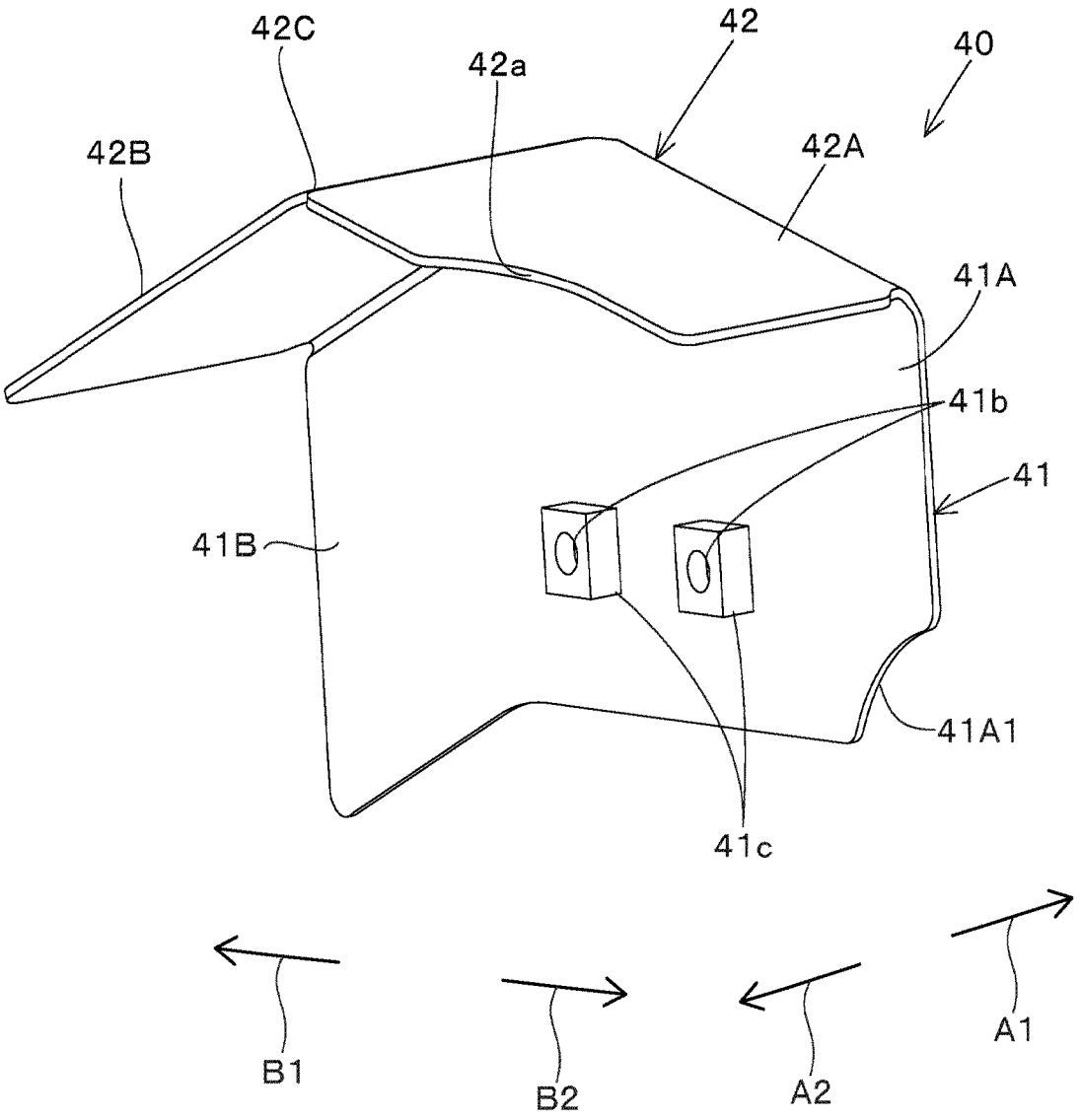
FIG. 6 is a perspective view illustrating a right-rear portion of the windshield plate according to the embodiment.
Figure 7:
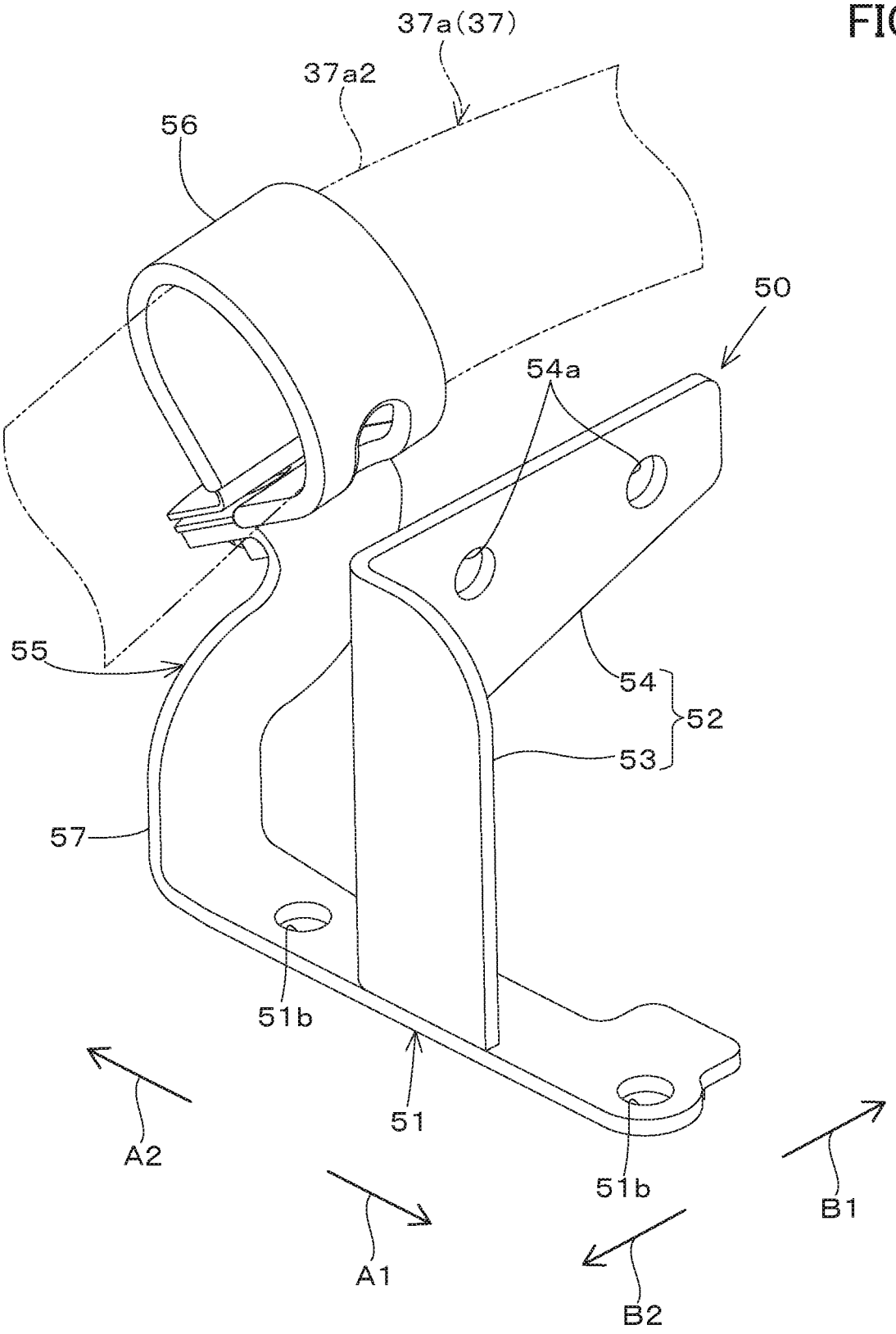
FIG. 7 is a perspective view illustrating a right-front portion of the bracket according to the embodiment.

FIG. 5 is an exploded perspective view of the wind shielding plate 40 viewed from the left front. FIG. 6 is a right-rear perspective view showing the back surface of the wind shielding plate 40. FIG. 7 is a left-front perspective view showing the bracket 50.

Figure 11A:
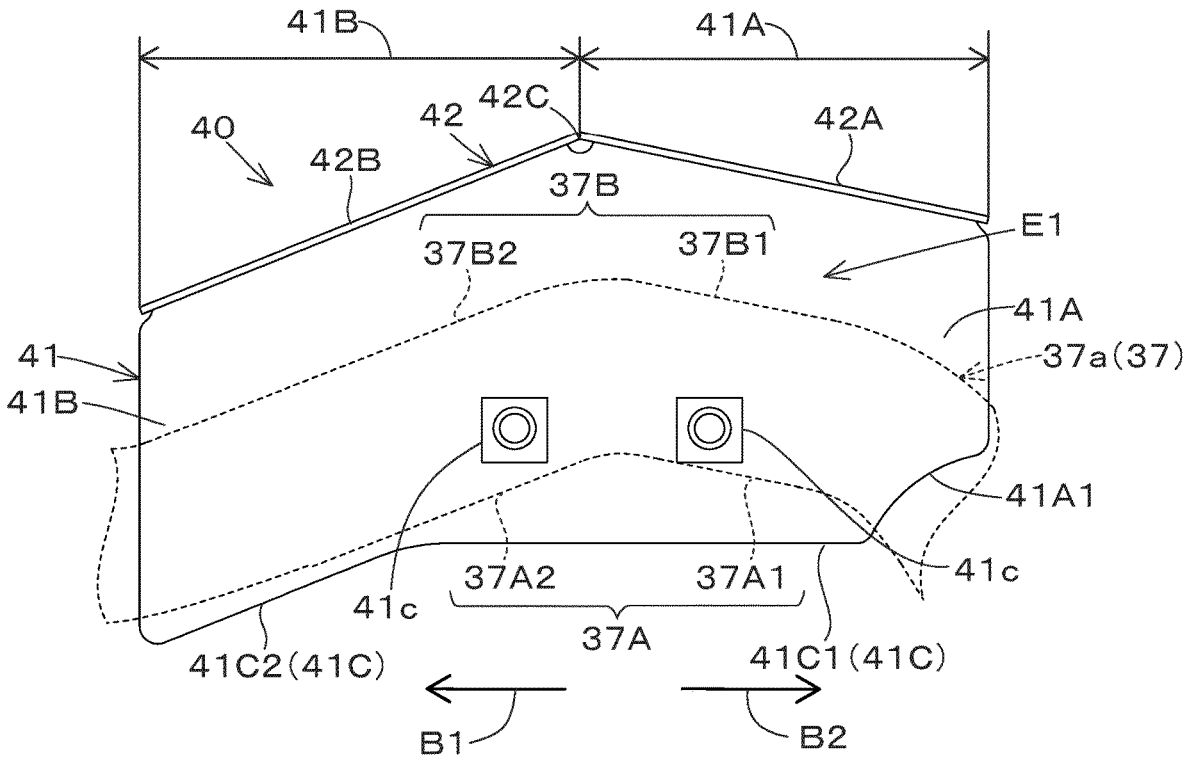
FIG. 11A is a left side view illustrating positions of the windshield plate and a connection tube according to the embodiment.
Figure 11B:
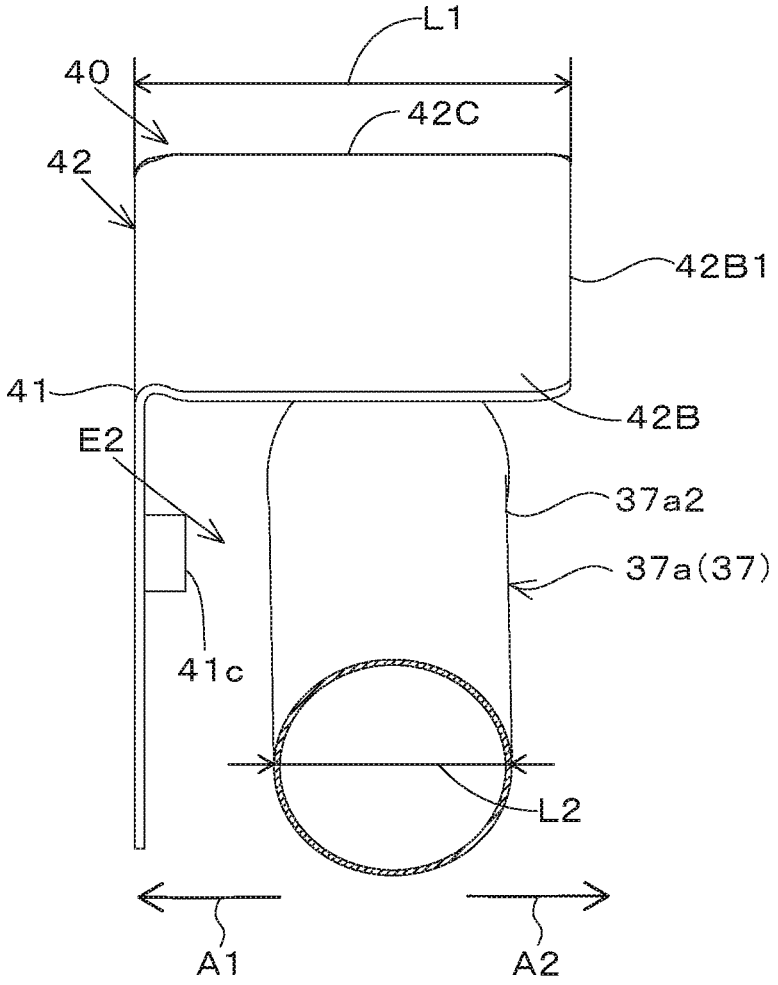
FIG. 11B is a back view illustrating the positions of the windshield plate and the connection tube according to the embodiment.

In FIG. 11A, the front surface side of the sheet indicates the rear, the back surface side of the sheet indicates the front, the arrowed line B1 indicates the left, and the arrowed line B2 indicates the right. FIG. 11B is a left side view showing the positions of the wind shielding plate 40 and the connection tube 37.

The wind shielding plate 40 is arranged around the connection tube 37 (radially outward). The wind shielding plate 40 is arranged to face at least a portion of the second portion 37*a*2 of the connection tube 37, the portion being adjacent to a portion connecting to the first portion 37*a*1, and thereby the portion is shielded from the cooling airflow.

In particular, the wind shielding plate 40 is arranged to face the upstream side portion and the middle portion of the second portion 37*a*2 in the present embodiment. The wind shielding plate 40 is provided on the prime mover 10 by the bracket 50. The wind shielding plate 40 includes a first plate portion 41 and a second plate portion 42.

The first plate portion 41 is arranged in front of the connection tube 37. The first plate portion 41 is arranged directing one surface of the first plate portion 41 forward and directing the other surface faces backward. In addition, the first plate portion 41 is arranged on the upstream side of the flow direction of the cooling airflow generated by the fan 21.

A through hole 41*b* is formed in the first plate portion 41, and a nut 41*c* having a screw hole communicated with the through hole 41*b* is attached to the first plate portion 41. The nut 41*c* is fixed to the rear side of the first plate portion 41 by the welding or the like. The first plate portion 41 is attached to the bracket 50 with a bolt 41*a* inserted into the nut 41*c*.

As shown in FIG. 11A and FIG. 11B, the first plate portion 41 includes a portion (first wall portion) 41A located on the right side and a portion (second wall portion) 41B located on the left side. The upper end portion of the first wall portion 41A is inclined downwardly rightward. A notch 41A1 having a substantially arc-shape is formed on the right lower end portion of the first wall 41A. The upper end portion of the second wall portion 41B is inclined downwardly leftward.

As shown in FIG. 5, FIG. 6, and the like, the second plate portion 42 is arranged extending backward from the upper portion of the first board part 41. The second plate portion 42 is arranged extending toward the downstream side of the flow direction of the cooling airflow generated by the fan 21. The second plate portion 42 is arranged above the connection tube 37. The second plate portion 42 includes a first portion 42A and a second portion 42B.

The first portion 42A is arranged extending backward from the right upper portion of the first plate portion 41. In particular, the first portion 42A is formed by bending the upper end portion of the first wall portion 41A.

The second portion 42B is arranged extending backward from the left upper portion of the first plate portion 41. In particular, the second portion 42B is formed by bending the upper end portion of the second wall portion 41B. A notch 42 having a substantially arc-shape is formed at the right rear portion of the second plate portion 42. The second plate portion 42 is formed such that the end portion of the first portion 42A and the end portion of the second portion 42B are adjacent or contacted to each other at the opposed portion 42C.

As shown in FIG. 11A, the first portion 42A and the second portion 42B are formed in a shape corresponding to the curved shape of the connection tube 37 so that the clearance from the upper surface of the connection tube 37 is substantially constant.

As shown in FIG. 1, the bracket 50 is attached to the rear upper portion of the cylinder head cover 20*c*. The wind shielding plate 40 is attached to the bracket 50. In particular, as shown in FIG. 5, the bracket 50 is attached by screwing a bolt 51*a* into a screw hole 51*c* formed in the rear upper portion of the cylinder head cover 20*c*.

As shown in FIG. 5 and FIG. 7, the bracket 50 has a first supporting portion 51 and a second supporting portion 52. The first supporting portion 51 is provided with a through hole 51*b* through which the bolt 51*a* is inserted. In the present embodiment, the first supporting portion 51 has a length in the front-rear direction longer than a length in the left-right direction. In addition, two through holes 51*b* are formed at intervals in the front-rear direction.

As shown in FIG. 5, the second supporting portion 52 is arranged extending upward from the upper surface of the first supporting portion 51. The second supporting portion 52 includes a vertical portion 53 and a fixing portion 54.

The vertical portion 53 stands upward from the upper surface of the first supporting portion 51. The vertical portion 53 has a rectangular shape whose length in the vertical direction is longer than the length in the front-rear direction. The vertical portion 53 is arranged to direct one surface leftward and direct the other surface faces rightward.

The fixing portion 54 is a portion to which the first plate portion 41 of the wind shielding plate 40 is attached. The fixing portion 54 is arranged extending leftward from the left upper portion of the vertical portion 53. The fixing portion 54 has an inverted L-shape having the upper portion extending, leftward, and is arranged to direct one surface forward and direct the other surface backward.

In the upper portion of the fixing portion 54, two through holes 54*a* penetrating in the front-rear direction are formed at intervals in the machine width direction. When the bolt 41*a* of the first plate portion 41 is inserted to the through hole 54*a* of the fixing portion 54 and then the bolt 41*a* is tightened, the wind shielding plate 40 can be attached to the bracket 50.

The bracket 50 also has a clamp member 55. In particular, the clamp member 55 is provided at the rear portion of the first supporting portion 51. The clamp member 55 clamps the connection tube 37. To explain in detail, the clamp member 55 has a holding portion 56 and a vertical portion 57.

The vertical portion 57 is arranged extending upward from the rear portion of the first plate portion 41. The vertical portion 57 is arranged with one surface directed forward and the other surface directed backward. A holding portion 56 is arranged at the upper end portion of the vertical portion 57. The holding portion 56 has a substantially P-shape in the side view.

By tightening the bolt 56*a*, the inner diameter of the holding portion 56 is reduced, and thus the holding portion 56 claims the connection tube 37. In addition, the structure of the holding part 56 is not limited to the above-mentioned structure, and any structure for clamping the connection 37 may be employed.

In the present embodiment, the wind shielding plate 40 is formed by bending a plate material such as metal. However, the material is not limited to that, and the wind shielding plate 40 may be formed of resin or the like. Moreover, the shape of the wind shielding plate 40 is not limited to the above-mentioned shape, and a shape as shown in FIG. 12 may be employed, for example.

Figure 12:
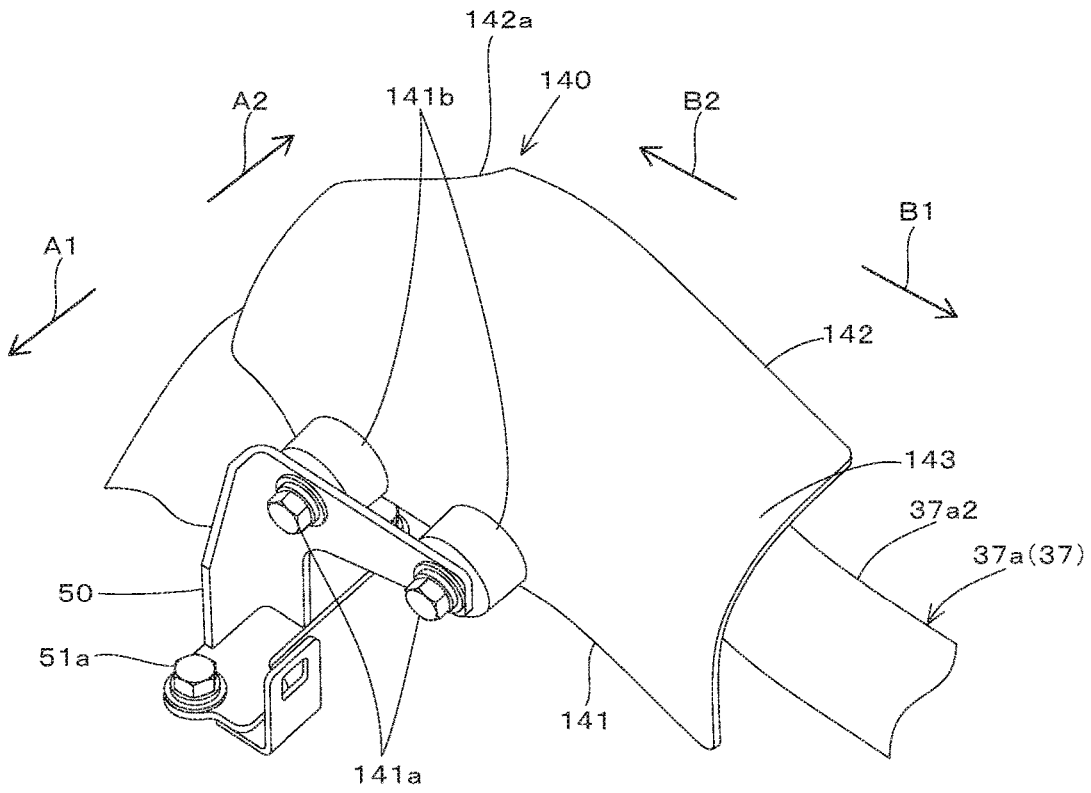
FIG. 12 is a perspective view illustrating a left front portion of a modified example of the windshield according to the embodiment.

FIG. 12 is a perspective view showing a left front portion of a wind shielding plate 140 that is a modified example of the wind shielding plate 40. As shown in FIG. 12, the wind shielding plate 140 has a first plate portion 141, a second plate portion 142, and an extended portion 143.

The first plate portion 141 is arranged in front of the connection tube 37. The first plate portion 141 has, for example, a substantially rectangular shape having the length in the left-right direction longer than the length in the vertical direction. The first plate portion 41 is attached to the bracket 50 with a bolt 141*a*.

Describing in detail, a boss 141*b* having a cylindrical shape protruding forward as shown in FIG. 12 is formed at the lower portion of the first plate portion 14. Two bosses 141*b* are formed at intervals in the machine width direction.

Inside the boss 141*b*, a nut (not shown in the drawings) whose axial direction is directed in the front-rear direction is molded in an inserted manner. The first plate portion 141 is fixed to the bracket 50 with the nut, the boss 141*b*, and the bolt 141*a*.

As shown in FIG. 12, the second plate portion 142 is arranged backwardly upward from the first plate portion 141. The second plate portion 142 and the first plate portion 141 are coupled with each other by the extended portion 143. The second plate portion 142 is arranged above the connection tube 37. The second plate portion 142 has a substantially rectangular shape in which the length in the left-right direction is longer than the length in the front-rear direction. A notch 142*a* having an arcuate shape is formed at the right rear portion of the second plate portion 142.

The extended portion 143 is arranged extending from the first plate portion 141 and connected to the second plate portion 142. In particular, the extended portion 143 is arranged extending from the upper end portion of the first plate portion 141 to the front end portion of the second plate portion 142, and extends so as to draw an arc in the side view.

As in the present embodiment, the wind shielding plate 40 covers not only a part of the connection tube 37 but the whole of the connection tube 37. In the present embodiment, the configuration where the wind shielding plate 40 is attached to the bracket 50 by a bolt. However, the configuration is not limited to that configuration, and the wind shielding plate 40 may be attached by the welding or the like.

Hereinafter, the wind shielding plate 40 will be described in detail with reference to FIG. 1, FIG. 8, FIG. 11A, and FIG. 11B. FIG. 8 is a back view illustrating the wind shielding plate 40, the fan 21 and the like.

As shown in FIG. 8, the wind shielding plate 40 is arranged above the engine housing 20 as viewed from the front or the rear (in a direction parallel to the rotation axis of the fan 21), and is overlapped with at least the rotation track R 1 of the fan 21.

In particular, the upper end of the rotation track RI of the fan 21 is higher than the upper end of the engine housing 20, and is arranged at a height between the upper end of the first plate portion 41 and the lower end.

As shown in FIG. 11A, the lower end portion (lower end portion of the first plate portion 41 other than the notch 41A1) 41C of the wind shielding plate 40 is located below the lower portion 37A of the connection tube 37. Describing in detail, the right portion 41C1 of the lower end portion 41C of the wind shielding plate 40 is arranged at a position lower than the right portion 37A1 of the lower portion 37A of the connection tube 37 by a predetermined distance in the back view.

In addition, the left portion 41C2 of the lower end portion 41C of the wind shielding plate 40 is arranged at a position lower than the left portion 37A2 of the lower portion 37A of the connection tube 37 by a predetermined distance in the back view. The left portion 41C2 and the left portion 37A2 are substantially parallel to each other.

Further, the wind shielding plate 40 and the connection tube 37 are separated from each other by a predetermined distance in the vertical direction. That is, a space portion E1 is formed between the second plate portion 42 of the wind shielding plate 40 and the outer circumferential surface of the connection tube 37. Describing the space E1 in detail, the space portion E1 includes a space formed between the first portion 42A and the right portion 37B 1 of the upper portion 37B of the connection tube 37, and a space formed between the second portion 42B and the left portion 37B2 of the upper portion 37B of the connection tube 37.

The first portion 42A and the right portion 37B 1 are separated from each other by a predetermined distance in the vertical direction, and are substantially parallel to each other. The second portion 42B and the left portion 37B2 are separated from each other by a predetermined distance in the vertical direction, and are substantially parallel to each other.

As shown in FIG. 11B, the length L1 of the wind shielding plate 40 in the front-rear direction, that is, the length L1 of the second plate portion 42 in the front-rear direction is longer than the outer diameter L2 of the connection tube 37. In addition, the connection tube 37 is arranged immediately below the second plate portion 42, and the connection tube 37 is positioned within the width of the second plate portion 42 in the front-rear direction.

That is, the connection tube 37 is arranged forward from the rear end 42B1 of the second plate portion 42. In addition, the wind shielding plate 40 and the connection tube 37 are separated from each other by a predetermined distance in the front-rear direction. That is, a space portion E2 is also formed between the first plate portion 41 of the wind shielding plate 40 and the outer circumferential surface of the connection tube 37.

As shown in FIG. 1 and FIG. 2, a first cooling tube 35*c* extends in the front-rear direction on the right side of the wind shielding plate 40. In addition, a second cooling tube 35*d* extends in the front-rear direction on the left side of the wind shielding plate 40. In other words, the wind shielding plate 40 is arranged between the first cooling tube 35*c* and the second cooling tube 35*d*.

Hereinafter, the flow (air flow) of the cooling airflow in the prime mover room ER will be described.

Figure 9:
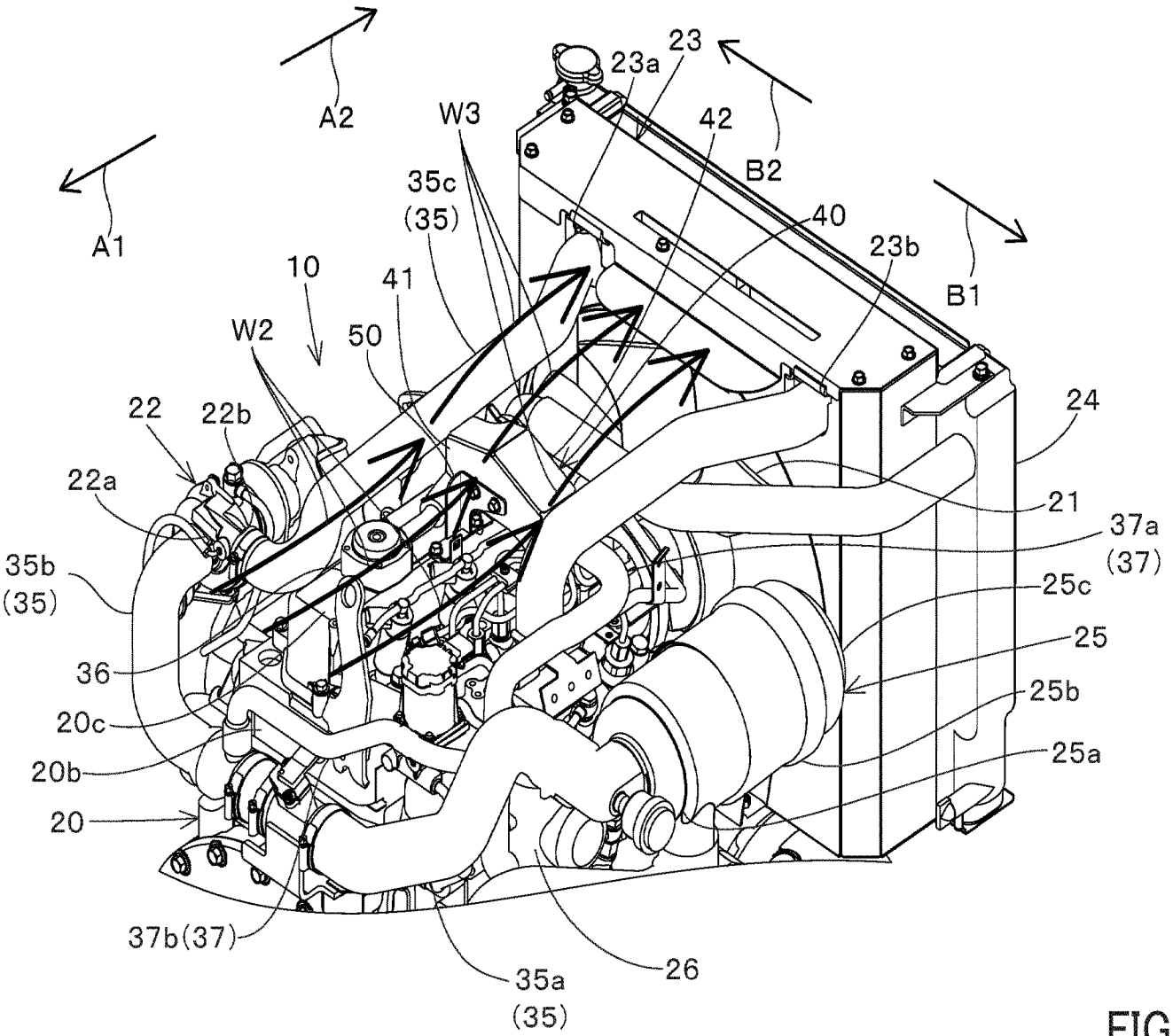
FIG. 9 is a perspective view illustrating left-front portions of the prime mover, a flow of cooling airflow, and the like according to the embodiment.
Figure 10:
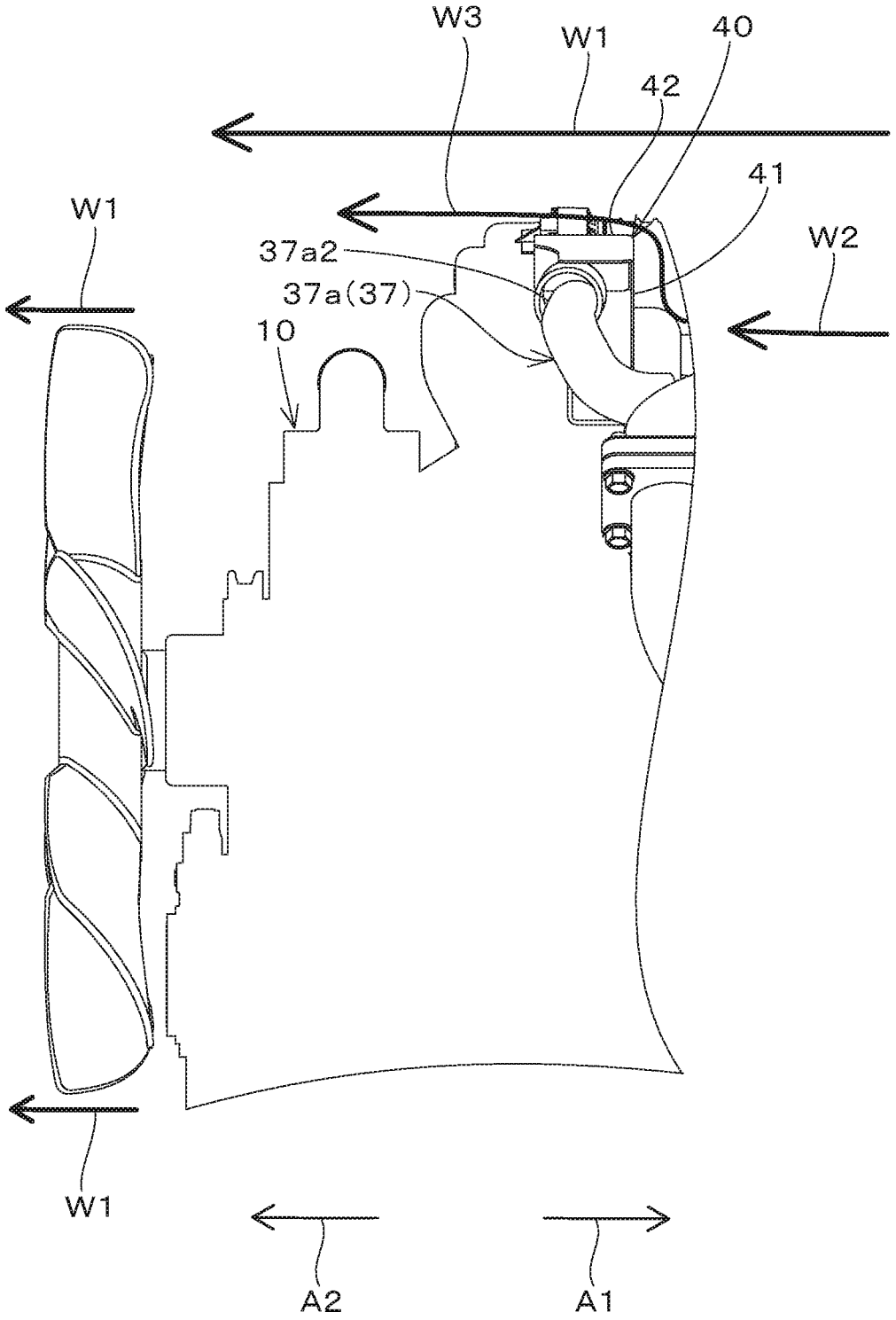
FIG. 10 is a view illustrating right sides of the prime mover, the flow of cooling airflow, and the like according to the embodiment.

FIG. 9 is a left front perspective view showing the left front portion of the prime mover 10, the flow of cooling airflow, and the like. FIG. 10 is a right side view showing the prime mover 10, the flow of cooling airflow, and the like.

As shown in FIG. 10, the fan 21 generates a cooling airflow W1 that travels from the front to the rear in the prime mover room ER. As shown in FIG. 9 and FIG. 10, the cooling airflow generated by the fan 21 flows toward the connection tube 37 in the prime mover room ER as indicated by the air flow W2.

The cooling airflow W2 that has flown toward the connection tube 37 hits the wind shielding plate 40, and then diffuses outward in the surface direction of the wind shielding plate 40 (for example, in the vertical direction and in the machine width direction) as shown in the air flow W3.

That is, the wind shielding plate 40 shields a part of the second portion 37*a*2 (the flow path intersecting portion 37*a*2 intersecting the flow path of the cooling airflow) of the connection tube 37 from the cooling airflow, and thus the cooling airflow flowing toward the connection tube 37 can be prevented from directly hitting the connection tube 37.

The cooling airflow diffused to the upper side of the wind shielding plate 40 is introduced backward from the connection tube 37 by the second plate portion 42. Thus, the wind shielding plate 40 arranged in front of the connection tube 37 shields the connection tube 37 from the cooling airflow.

Hereinafter, the operation of the blow-by gas recirculation structure 30 will be described with reference to FIG. 4. When the fuel is combusted in the combustion chamber 34 of the engine housing 20, the blow-by gas leaks from the gap between the cylinder and the piston ring due to the rapid pressure increase and flows into the engine housing (crankcase) 20.

The blow-by gas comes into contact with the engine oil adhering to the inner circumferential surface of the cylinder when passing through the gap, and absorbs (includes) the misty engine oil. The blow-by gas flows from the cylinder head cover 20*c* into the oil separator 26 through the first connection tube 37*a*.

When the blow-by gas passes through the first connection tube 37*a*, the cooling airflow flows toward the first connection tube 37*a* (from the front toward the rear). However, in the present embodiment, the wind shielding plate 40 shields the first connection tube 37*a* from the cooling airflow.

For this reason, even under a cryogenic condition such as a cold area, it is possible to suppress that the blow-by gas is cooled inside the connection tube 37 and the liquid such as oil or water contained in the blow-by gas is frozen. In this manner, the liquid in the blow-by gas can be prevented from freezing inside the connection tube 37, and the inside of the connection tube 37 can be prevented from being clogged. As the result, the pressure in the engine housing 20 can be prevented from increasing, and thus it is possible to avoid the oil leakage and the like.

In addition, the wind shielding plate 40 is arranged closer to the connection portion 36 than at least at a middle portion between the connection portion 36 of the connection tube 37 with the engine housing 20 and the connection portion with the oil separator 26. In this manner, the blow-by gas can flow into the intake tube 35 through a region intersecting with the flow path of the cooling airflow in the connection tube 37 while keeping the temperature of the blow-by gas to a temperature relatively close to the temperature of the connection portion 36.

The oil separator 26 separates the engine oil contained in the blow-by gas. The engine oil captured by the filter (the oil separator) 26 passes through the oil return path 26*a* due to the gravity fall and returns to the inside of the engine housing 20.

When flowing out from the oil separator 26, the blow-by gas from which the engine oil has been removed flows into the second air intake tube 35*b* through the second connection tube 37*b*. In this manner, the blow-by gas merges with the air taken in from the air cleaner 25, and flows into the inlet 22*a* of the supercharger 22 on the compressor side.

The supercharger 22 rotates the turbine with use of the exhaust from the prime mover 10 to compress the air on the compressor side. The air compressed by the compressor of the supercharger 22 (the mixture of the air taken in from the outside air and the blow-by gas) flows from the outlet 22*b* on the compressor side into the inlet 23*a* of the intercooler through the first cooling tube 35*c*.

The air cooled by the intercooler 23 flows from the outlet 23*b* of the intercooler through the second cooling tube 35*d*, flows into the cylinder 13*a*, and then is combusted. In this manner, the blow-by gas generated in the engine housing 20 is mixed with the air taken from the outside air, and then is re-combusted.

The working machine 1 of the present embodiment has the following effects.

The prime mover 10 includes the fan 21 to generate a cooling airflow around the engine 10, the air-intake tube 35 to supply the outside air to the engine, the connection tube 37 to supply, to the air-intake tube 35, the blow-by gas generated in the engine 10, and the wind shielding, member 40 to shield the connection tube 37 from the cooling airflow. The wind shielding member 40 is arranged around the connection tube 37.

According to that configuration, it is possible to avoid that the cooling airflow generated by the fan 21 directly hits the connection tube 37 and thereby the connection tube 37 is cooled. For this reason, even under a cryogenic condition such as a cold area, the blow-by gas can be prevented from being cooled in the connection tube 37, and it is possible to suppress freezing of the liquid such as the oil contained in the blow-by gas.

In addition, the connection tube 37 includes the flow path intersecting portion 37*a*2 that intersects with the flow path of the cooling airflow, and the wind shielding member 40 is arranged at a position opposed to the flow path intersecting portion 37*a*2 in the connection tube 37. According to that configuration, the wind shielding member 40 can shut off the cooling airflow flowing to the connection tube 37. In this manner, the blow-by gas can be cooled inside the connection tube 37, and it is possible to suppress the freezing of the liquid such as the oil and the moisture contained in the blow-by gas.

Further, the fan 21 is arranged to suck the air from a side of the engine 10 and to output the air toward a direction separating from the engine 10. According to that configuration, the fan 21 can discharge, to the outside, the air relatively high temperature staying around the engine 10. In this manner, the fan 21 can cool the circumference of the engine 10, and cools the intercooler 23 and the like.

Further, as shown in FIG. 1, FIG. 2, FIG. 8, and the like, the wind shielding member 40 overlaps with the rotation track RI of the fan 21 as viewed in the front-rear direction when seen in a direction parallel to a rotation shaft of the fan 21. According to that configuration, even when the connection tube 37 is arranged in the rotation track RI of the fan 21 where the wind speed of the cooling airflow is relatively strong, the wind shielding member 10 can prevent the cooling airflow generated by the fan 21 from directly hitting the connection tube 37.

In addition, the connection tube 37 is arranged above the engine 10, and the wind shielding, member 40 is provided with the first plate portion 41 arranged on the upstream side of the flow path direction of the cooling airflow in the connection tube 37, and a second plate portion 42 arranged above the connection tube 37 and extending from the upper portion of the plate portion 41 toward the downstream side of the cooling airflow in the flow path direction.

According to that configuration, the connection tube 37 can be appropriately shielded from the cooling airflow.

Further, the opposed portion 42C of the connection tube 37 opposed to the wind shielding member 40, includes the curved portion, and the second plate portion 42 includes the first portion opposed to a portion of the connection tube 37, the portion being closer to one end side of the connection tube 37 than the curved portion, and the second portion 42B closer to another portion of the connection tube 37, the other portion being closer to the other end side than the curved portion.

According to that configuration, even when the connection tube 37 is curved, the connection tube 37 can be covered with the wind shielding member 40 having a compact configuration. In this manner, the wind shielding member 40 can be attached to the prime mover 10 even when the clearance around the prime mover 10 is narrow.

Further, the prime mover 10 includes the bracket 50 to attach the wind shielding member 40 to the engine 10, and the bracket includes the first supporting portion 51 attached to an upper portion of the engine 10, the second supporting portion 52 supporting the first plate portion 41, and the clamp member 55 clamping the connection tube 37.

According to that configuration, the member for attaching the wind shielding member 40 to the prime mover 10 and the member for supporting the connection tube 37 can be provided in a single member. In this manner, the number of members can be reduced, the production process can be reduced, and thus the production cost can be reduced.

Further, the prime mover 10 includes the filter 26 to remove the oil included in the blow-by gas. The connection tube 37 includes one end portion connected to the engine housing 20 of the engine 10, and the other end portion connected to the filter 26. And, the wind shielding member 40 is arranged opposed to a portion of the connection tube 37, the portion being closer to the one end portion than a middle portion of the connection tube 37 between the one end portion and the other end portion.

According to that configuration, it is possible to avoid that the blow-by gas is rapidly cooled by the cooling airflow before the oil is removed from the blow-by gas just having flown into the connection tube 37.

That is, the speed of the temperature drop due to the influence of the cooling airflow can be delayed for a time until the blow-by gas reaches the air intake tube 35 through the connection tube 37. That is, the temperature decrease of the blow-by gas can be suppressed in the connection tube 37.

In addition, the working machine 1 is provided with the prime mover 10 described above. According to that configuration, it is possible to provide the working machine 1 providing the excellent effect of the wind shielding member 40 described above.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modified examples within and equivalent to a scope of the claims.

What is claimed is:

1. A prime mover comprising:

an engine;

a fan to generate a cooling airflow around the engine;

an air-intake tube to supply outside air to the engine;

a connection tube to supply, to the air-intake tube, a blow-by gas generated in the engine; and a wind shielding member to shield the connection tube from the cooling airflow, the wind shielding member being arranged around the connection tube, wherein the connection tube includes a flow-path intersecting portion located so as to intersect with an axis of a rotation shaft of the fan in plan view and intersecting with a flow path of the cooling airflow, the fan is arranged to suck air from a side of the engine and to output the air toward a direction separating from the engine, the engine being located upstream of the fan in the flow path of the cooling airflow, and the wind shielding member is arranged beside a surface of the flow-path intersecting portion on an upstream side of the flow path of the cooling airflow and is arranged opposed to the surface of the flow-path intersecting portion on the upstream side, the surface facing away from the fan.

2. The prime mover according to claim 1, wherein the wind shielding member is overlapped with a rotation track of the fan when seen in a direction parallel to a rotation shaft of the fan.

3. The prime mover according to claim 1, wherein the connection tube is arranged extending above the engine, and wherein the wind shielding member includes:

a first plate portion arranged opposed to the surface of the flow-path intersecting portion on the upstream side; and a second plate portion extending from an upper portion of the first plate portion toward a downstream side of the direction of the flow path of the cooling airflow, the second plate portion being arranged above the flow-path intersecting portion.

4. The prime mover according to claim 3, wherein an opposed portion opposed to the wind shielding member, the opposed portion being included in the connection tube, includes a curved portion, and wherein the second plate portion includes:

a first portion opposed to a portion of the connection tube, the portion being closer to one end side of the connection tube than the curved portion; and a second portion closer to another portion of the connection tube, the other portion being closer to the other end side than the curved portion.

5. The prime mover according to claim 3, further comprising:

a bracket to attach the wind shielding member to the engine, the bracket including:

a first supporting portion attached to an upper portion of the engine;

a second supporting portion supporting the first plate portion; and a clamp member clamping the connection tube.

6. The prime mover according to claim 1, further comprising:

a filter to remove an oil included in the blow-by gas, wherein the connection tube includes:

one end portion connected to an engine housing of the engine; and the other end portion connected to the filter, and wherein the wind shielding member is arranged opposed to a portion of the connection tube, the portion being closer to the one end portion than a middle portion of the connection tube between the one end portion and the other end portion.

7. A working machine, comprising:

the prime mover according to claim 1.

* * * * *